US008394752B2

(12) United States Patent
Erbezci et al.

(10) Patent No.: US 8,394,752 B2
(45) Date of Patent: Mar. 12, 2013

(54) PEARLESCENT AGENT SLURRY FOR LIQUID TREATMENT COMPOSITION

(75) Inventors: Omer Erbezci, Vilvoorde (BE); Theresa Anne John, Cincinnati, OH (US); Bruno Jean-Pierre Matthys, Brussels (BE); Lucia Prada-Fernandez, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/633,843

(22) Filed: Dec. 9, 2009

(65) Prior Publication Data

US 2011/0136721 A1 Jun. 9, 2011

Related U.S. Application Data

(60) Provisional application No. 61/138,567, filed on Dec. 18, 2008.

(51) Int. Cl.
*C11D 3/00* (2006.01)

(52) U.S. Cl. ..... 510/405; 510/513; 524/291; 524/321; 524/401

(58) Field of Classification Search ..... 510/405; 524/291, 321, 401
See application file for complete search history.

(56) References Cited

U.S. PATENT DOCUMENTS

| | | | | |
|---|---|---|---|---|
| 2,220,099 | A | 11/1940 | Heidelberg et al. | |
| 2,477,383 | A | 7/1949 | Lewis | |
| 3,308,067 | A | 3/1967 | Diehl | |
| 3,664,961 | A | 5/1972 | Norris | |
| 3,723,322 | A | 3/1973 | Diehl | |
| 3,835,163 | A | 9/1974 | Rapko | |
| 3,919,678 | A | 11/1975 | Penfold | |
| 3,923,679 | A | 12/1975 | Rapko | |
| 4,102,903 | A | 7/1978 | Crutchfield et al. | |
| 4,120,874 | A | 10/1978 | Crutchfield et al. | |
| 4,144,226 | A | 3/1979 | Crutchfield et al. | |
| 4,158,635 | A | 6/1979 | Crutchfield et al. | |
| 4,222,905 | A | 9/1980 | Cockrell | |
| 4,239,659 | A | 12/1980 | Murphy | |
| 4,326,052 | A | 4/1982 | Kang et al. | |
| 4,326,053 | A | 4/1982 | Kang et al. | |
| 4,377,636 | A | 3/1983 | Kang et al. | |
| 4,385,123 | A | 5/1983 | Kang et al. | |
| 4,566,984 | A | 1/1986 | Bush | |
| 4,717,501 | A | 1/1988 | Hirota et al. | |
| 5,017,305 | A | 5/1991 | Hoeffkes et al. | |
| 5,389,284 | A * | 2/1995 | van der Hoeven et al. | 510/413 |
| 5,403,508 | A * | 4/1995 | Reng et al. | 510/119 |
| 5,445,747 | A | 8/1995 | Kvietok et al. | |
| 5,500,138 | A | 3/1996 | Bacon et al. | |
| 5,531,910 | A | 7/1996 | Severns et al. | |
| 5,646,101 | A | 7/1997 | MacBeath et al. | |
| 5,686,014 | A | 11/1997 | Baillely et al. | |
| 5,695,679 | A | 12/1997 | Christie et al. | |
| 5,698,504 | A | 12/1997 | Christie et al. | |
| 5,705,464 | A | 1/1998 | Scheper et al. | |
| 5,710,115 | A | 1/1998 | Patel et al. | |
| 6,210,659 | B1 | 4/2001 | Wilhelm et al. | |
| 6,416,766 | B1 * | 7/2002 | Kobayashi et al. | 424/401 |
| 6,491,840 | B1 | 12/2002 | Frankenbach et al. | |
| 6,835,700 | B1 | 12/2004 | Nieendick et al. | |
| 6,903,061 | B2 | 6/2005 | Masschelein et al. | |
| 6,908,890 | B2 * | 6/2005 | Oldenhove | 510/159 |
| 6,956,017 | B1 | 10/2005 | Catalan et al. | |
| 7,022,656 | B2 | 4/2006 | Verrall et al. | |
| 7,217,752 | B2 * | 5/2007 | Schmucker-Castner et al. | 524/291 |
| 2004/0151910 | A1 * | 8/2004 | Koller et al. | 428/403 |
| 2004/0235690 | A1 * | 11/2004 | Oldenhove | 510/130 |
| 2009/0088363 | A1 * | 4/2009 | Panandiker et al. | 510/343 |
| 2009/0215951 | A1 | 8/2009 | Kust | |

FOREIGN PATENT DOCUMENTS

| | | | |
|---|---|---|---|
| EP | 520551 | B1 | 3/1996 |
| EP | 1975225 | A1 | 10/2008 |
| WO | WO 2007/111899 | A2 | 10/2007 |

OTHER PUBLICATIONS

Ash et al. Surfactants, 1993.*
Surfactants, Surface active agents. Date is not applicable.*
International Search Report, dated Apr. 23, 2010, 13 pages.

* cited by examiner

*Primary Examiner* — Mark Eashoo
*Assistant Examiner* — M. Reza Asdjodi
(74) *Attorney, Agent, or Firm* — Melissa G. Krasovec; Steven W. Miller

(57) ABSTRACT

An inorganic pearlescent agent slurry for use in liquid treatment compositions. The slurry comprises: inorganic pearlescent agent; organic solvent, selected from the group consisting of glycerol, sorbitol and mixtures thereof; and rheology modifier. The inorganic pearlescent agent may be selected from the group consisting of mica, bismuth oxychloride, and mixtures thereof.

20 Claims, No Drawings

PEARLESCENT AGENT SLURRY FOR LIQUID TREATMENT COMPOSITION

CROSS REFERENCE TO RELATED APPLICATION

This application claims the benefit of U.S. Provisional Application No. 61/138,567, filed Dec. 18, 2008.

TECHNICAL FIELD

The present invention relates to a slurry, which is suitable for use as a component of liquid treatment compositions.

BACKGROUND OF THE INVENTION

In the preparation of liquid treatment compositions, it is an aim to improve technical capabilities thereof and aesthetics. One method of improving the aesthetics of a liquid treatment composition is to make it pearlescent.

Pearlescence can be achieved by incorporation of a pearlescent agent into the liquid treatment composition. Pearlescent agents include inorganic natural substances, such as mica, bismuth oxychloride and titanium dioxide, and organic compounds such as metal salts of higher fatty acids, fatty glycol esters and fatty acid alkanolamides. The present invention relates only to the use of inorganic pearlescent agents. The pearlescent agent can be acquired as a powder, suspension of the agent in a suitable suspending agent or, where the agent is a crystal, it may be produced in situ.

Detergent compositions and pearlescent dispersions comprising pearlescent agent fatty acid glycol ester are disclosed in the following art; U.S. Pat. No. 4,717,501 (to Kao); U.S. Pat. No. 5,017,305 (to Henkel); U.S. Pat. No. 6,210,659 (to Henkel); U.S. Pat. No. 6,835,700 (to Cognis). Liquid treatment compositions containing pearlescent agents are disclosed in U.S. Pat. No. 6,956,017 (to Procter & Gamble). Liquid detergents for washing delicate garments containing pearlescent agent are disclosed in EP 520551 B1 (to Unilever).

The present invention relates to a slurry comprising inorganic pearlescent agent. The slurry described in WO2007/111899A2 (to Procter & Gamble) uses water as the carrier for pearlescent agent. However, the Applicants have discovered that using water as the carrier for pearlescent agent only allows up to six weeks of physical stability, before the pearlescent agent starts to settle.

The inorganic pearlescent agent slurry of WO2007/11189 is prepared in a batch process. A measured quantity of the inorganic pearlescent agent slurry is then added to the continuous process used to prepare liquid treatment compositions. However, as discussed above, the inorganic pearlescent agents tend to settle from the slurry suspension. This settling causes problems in the continuous processing used to prepare the liquid treatment compositions, since there will be points when there may be too much pearlecence or no pearlecence at all.

One potential solution to these problems may be to increase the viscosity of the slurry. However the end products necessarily have relatively low viscosity, especially at high shear, such that they may be poured or processed. Therefore components of the liquid treatment composition, like the slurry, should not have too high viscosity. Contrarily, if the slurry has low viscosity at low shear, the particulates have a tendency to fall out of suspension and either float or sink upon storage. This results in an undesired, non-homogenous slurry, wherein part of the slurry is pearly and part of it is clear and homogeneous. Such a slurry clearly would have an undesirable effect on the aesthetics of the final composition, which may have too much pearlecence or no pearlecence at all. Hence the Applicant has found that simply varying the viscosity of the slurry, does not adequately solve the problems as set out in the present invention.

Moreover, inorganic pearlescent agents are insoluble and without adequate solution, behave like wet sand, causing problems in processing of the slurry. The wet sand behavior makes the slurry difficult to mix and requires considerable effort from the equipment used in the mixing process.

The present invention provides a slurry and a procedure to prepare the slurry suitable for further processing into a liquid treatment compositions. The present invention specifically relates to improving the physical stability and process lifetime of an inorganic pearlescent agent slurry, and thereby improving the process of preparation and quality of the liquid treatment composition. The present invention also relates to the use of combination of solvent and rheology modifier in a slurry of inorganic pearlescent agents to improve the physical stability and the process lifetime of the slurry. The Applicants have discovered that replacing water by either glycerol or sorbitol solvent increases the physical stability of the slurry, in that the slurry remains physically stable 16 weeks. The present invention also relates to an optimized the process of preparing the inorganic pearlescent agent slurry wherein the addition of inorganic pearlescent agent is strictly controlled.

SUMMARY OF THE INVENTION

According to the present invention there is provided an inorganic pearlescent agent slurry suitable for use in a liquid treatment composition comprising:

a) inorganic pearlescent agent
b) organic solvent, selected from the group consisting of glycerol, sorbitol and mixtures thereof.
c) rheology modifier.

The present invention also relates to a process of preparing an inorganic pearlescent agent slurry, for use in liquid treatment compositions, comprising the steps of:

a) combining organic solvent, selected from the group consisting of glycerol and sorbitol and mixtures thereof and from 10% to 66% by weight of the 100% active inorganic pearlescent agent;
b) adding rheology modifier and mixing; and
c) adding remaining inorganic pearlescent agent.

DETAILED DESCRIPTION OF THE INVENTION

In the present invention, the term slurry is used herein to mean a liquid composition that is typically flowable at ambient temperature and contains water-insoluble solid particulates or other solid matter.

The inorganic pearlescent agent slurry of the present invention is suitable for use as a component of liquid treatment compositions suitable for laundry or house hold care applications. By the term laundry treatment composition it is meant to include all liquid compositions used in the treatment of laundry including cleaning and softening or conditioning compositions. By the term hard surface treatment composition it is meant to include all liquid compositions used in the treatment of hard surfaces, such as kitchen or bathroom surfaces, as well as dish and cook ware in the hand or automatic dishwashing operations.

The pearlescent agent slurry according to the present invention for this use comprises from 30% to 60% water. However there is preferably no freely added water. Where water does exist in the slurry, it is preferably present as a component of another ingredient of the slurry, such as the rheology modifier premix.

The inorganic pearlescent agent slurry of the present invention preferably has viscosity from 21000 to 65000 centipoises at 0.5 $s^{-1}$ and from 1000 to 3000 centipoises at 20 $s^{-1}$. Viscosity can be determined by conventional methods. Viscosity according to the present invention is however measured using an AR 550 rheometer from TA instruments using a plate steel spindle at 40 mm diameter and a gap size of 500 μm. The high shear viscosity at 20 $s^{-1}$ and low shear viscosity at $0.5^{-1}$ can be obtained from a logarithmic shear rate sweep from $0.1^{-1}$ to $25^{-1}$ in 3 minutes time at 21° C.

The slurry of the present invention preferably has a pH of from 7 to 11, more preferably from 7 to 9 when measured directly from the slurry.

The temperature of the slurry and throughout the preparation and storage is preferably below 35° C. When the used rheology modifier is Hydrogenated Castor Oil (HCO), the temperature is more preferably between 10° C. and 30° C. HCO has a low melting point and will lose the rheology modifier activity when melted and cause the instability of the slurry.

Pearlescent Agent

The pearlescent agents according to the present invention are inorganic crystalline or glassy solids, transparent or translucent compounds capable of reflecting and refracting light to produce a pearlescent effect. Typically, the pearlescent agents are crystalline particles insoluble in the composition in which they are incorporated. Preferably the pearlescent agents have the shape of thin plates or spheres. Spheres, according to the present invention, are to be interpreted as generally spherical. Particle size is measured across the largest diameter of the sphere. Plate-like particles are such that two dimensions of the particle (length and width) are at least 5 times the third dimension (depth or thickness). Other crystal shapes like cubes or needles or other crystal shapes do not display pearlescent effect. Many pearlescent agents like mica are natural minerals having monoclinic crystals. Shape appears to affect the stability of the agents. The spherical, even more preferably, the plate-like agents being the most successfully stabilised.

The mechanism of pearlescence is described by R. L. Crombie in International Journal of Cosmetic Science Vol 19, page 205-214. Light reflected from pearl platelets or spheres, as they lie essentially parallel to each other at different levels in the composition creates a sense of depth and luster. Some light is reflected off the pearlescent agent, and the remainder will pass through the agent. Thus light passing through the pearlescent agent, may pass directly through or be refracted. Reflected, refracted light produces a different colors, brightness and luster.

The smaller the particle size and distribution of the pearlescent agent, the more easily they are suspended. However as the particle size of the pearlescent agent is decreased, the efficacy of the agent is also decreased. It is therefore preferred that in the present invention the pearlescent agent has particle size preferable between 5 and 32 micrometers and more preferably between 5 and 26 micrometers.

The slurry of the present invention preferably comprise from 1% to 35% by weight of the slurry of a 100% active inorganic pearlescent agent. More preferably the slurry comprises from 10% to 30%, more preferably from 10% to 20%, by weight of the slurry of the 100% active inorganic pearlescent agent.

The pearlescent agents of the present invention are inorganic. Inorganic pearlescent agents provide both dynamic and static pearlescent effect. By dynamic pearlescence it is meant that the composition exhibits a pearlescent effect when the composition is in motion. By static pearlescence it is meant that the composition exhibits pearlescence when the composition is static.

Inorganic Pearlescent Agents:

Inorganic pearlescent agents include those selected from the group consisting of mica, metal oxide coated mica, silica coated mica, bismuth oxychloride coated mica, bismuth oxychloride, myristyl myristate, glass, metal oxide coated glass, guanine, glitter (polyester or metallic) and mixtures thereof.

Suitable micas include muscovite or potassium aluminum hydroxide fluoride. The platelets of mica are preferably coated with a thin layer of metal oxide. Preferred metal oxides are selected from the group consisting of rutile, titanium dioxide, ferric oxide, tin oxide, alumina and mixtures thereof.

Pearlecence effect in these pearlescent agents develops through interference between light rays reflecting at specular angles from the top and bottom surfaces of the metal-oxide layer. The agents loose color intensity as viewing angle shifts to non-specular angles and gives it the pearlescent appearance.

More preferably inorganic pearlescent agents are selected from the group consisting of mica and bismuth oxychloride and mixtures thereof. More preferably inorganic pearlescent agents are mica. More preferably the pearlescent agent is metal oxide coated mica, more preferable titanium oxide coated mica, bismuth oxychloride coated mica or silica coated mica and mixtures thereof.

Commercially available suitable inorganic pearlescent agents are available from Merck under the trade names Iriodin, Biron, Xirona, Timiron Colorona, Dichrona, Candurin and Ronastar. Other commercially available inorganic pearlescent agent are available from BASF (Engelhard, Mearl) under trade names Biju, Bi-Lite, Chroma-Lite, Pearl-Glo, Mearlite and Eckart under the trade names Prestige Soft Silver and Prestige Silk Silver Star.

Inorganic pearlescent agents are preferably incorporated as a powder, and are used to prepare the slurry without the need for any additional process steps. Process to prepare the slurry will be described in more details later on.

Organic Solvent system

The solvent system in combination with the rheology modifier are essential in driving physically stability in the slurry. Suitable solvents according to the present invention are organic solvents, selected from the group consisting of glycerol and sorbitol and mixtures thereof. Solvent is typically present at levels in the range from 10% to 50%, preferably from 20% to 40% by weight of the slurry.

Glycerol is a colorless, odorless and viscous liquid. It is sweet-tasting and of low toxicity. Glycerol has three hydroxyl groups that are responsible for its solubility in water and its hydroscopic nature.

Sorbitol is a sugar alcohol, which has six hydroxyl groups that are responsible for its solubility in water and its hydroscopic nature.

Without wishing to be bound by the theory it is believed that a synergy exits between the solvent and rheology modifier. It is further believed that the system comprising these two elements created more elasticity within the system. This elasticity appears to mean the system or network is able to recover more quickly following shear.

Rheology Modifier

The slurry of the present invention comprises a rheology modifier. The overall objective in adding such a rheology modifier to the slurry herein is to arrive at a slurry which is suitably functional and aesthetically pleasing from the standpoint of slurry thickness, pourability, physically stability, optical properties, and/or particles suspension performance. Thus the rheology modifier will serve to establish appropriate rheological characteristics of the slurry and will do so without imparting any undesirable attributes to the product such as unacceptable optical properties or unwanted phase separation. By rheological characteristics are meant characteristics of the flow of the slurry under stress and strain.

The rheology modifier component of the pearlescent agent slurry herein can be characterized as an "external" or "internal" rheology modifier. An "external" rheology modifier, for the purposes of this invention, is a material which has as its primary function that of providing rheological alteration of the liquid matrix. Generally, therefore, an external rheology modifier will not, in and of itself, provide any significant fabric cleaning or fabric care benefit or any significant ingredient solubilization benefit. An external rheology modifier is thus distinct from an "internal" rheology modifier which may also alter matrix rheology but which has been incorporated into the liquid product for some additional primary purpose. Thus, for example, a preferred internal rheology modifier would be anionic surfactants which can serve to alter rheological properties of the slurry, but which have been added to the slurry primarily to act as the cleaning ingredient in the final product.

The rheology modifier of the slurry of the present invention is used to provide a liquid matrix for the pearlescent agent slurry which has certain rheological characteristics. The principal characteristic is that the matrix must be "shear-thinning". A shear-thinning fluid is one with a viscosity which decreases as shear is applied to the fluid. Thus, at rest, i.e., during storage or shipping of the slurry the liquid matrix of the slurry should have a relatively high viscosity.

When shear is applied to the pearlescent agent slurry, however, such as in the act of pouring, pumping or mixing the slurry the viscosity of the matrix should be lowered to the extent that dispensing and mixing of the slurry is easily and readily accomplished.

One type of rheological modifier agent which is especially useful in the slurry of the present invention comprises non-polymeric (except for conventional alkoxylation), crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes.

Specific examples of preferred crystalline, hydroxyl-containing rheology modifiers include castor oil and its derivatives. Especially preferred derivatives are such as hydrogenated castor oil (HCO) and hydrogenated castor wax. Commercially available, castor oil-based, crystalline, hydroxyl-containing rheology modifiers include THIXCIN® from Rheox, Inc. (now Elementis).

Alternative commercially available materials are those suitable for use as crystalline, hydroxyl-containing rheology modifiers. An example of a rheology modifier of this type is 1,4-di-O-benzyl-D-Threitol in the R,R, and S,S forms and any mixtures, optically active or not.

All of these crystalline, hydroxyl-containing rheology modifiers as hereinbefore described are believed to function by forming thread-like structuring systems when they are crystallized in situ within the liquid matrix of the slurry herein or within a pre-mix which is used to form such a liquid matrix. Such crystallization is brought about by heating an aqueous mixture of these materials to a temperature above the melting point of the rheology modifier, followed by cooling of the mixture to room temperature while maintaining the liquid under agitation. Other types of rheology modifiers, besides the non-polymeric, crystalline, hydroxyl-containing rheology modifiers described hereinbefore, may be utilized in the slurry herein. Polymeric materials which will provide shear-thinning characteristics to the aqueous liquid matrix may also be employed.

Suitable polymeric rheology modifiers include those of the polyacrylate, polysaccharide or polysaccharide derivative type. Polysaccharide derivatives typically used as rheology modifiers comprise polymeric gum materials. Such gums include pectine, alginate, arabinogalactan (gum Arabic), carrageenan, gellan gum, xanthan gum and guar gum.

If polymeric rheology modifiers are employed herein, a preferred material of this type is gellan gum. Gellan gum is a heteropolysaccharide prepared by fermentation of Pseudomonaselodea ATCC 31461. Gellan gum is commercially marketed by CP Kelco U.S., Inc. under the KELCO-GEL trade name. Processes for preparing gellan gum are described in U.S. Pat. Nos. 4,326,052; 4,326,053; 4,377,636 and 4,385,123.

In an other preferred embodiment the rheology modifier is a polyacrylate of unsaturated mono- or di-carbonic acid and 1-30C alkyl ester of the (meth) acrylic acid. Such copolymers are available from Noveon Inc under the tradename Carbopol Aqua 30.

Preferably the rheology modifier of the present invention is an external rheology modifier. The rheology modifier is selected from the group consisting of non-polymeric crystalline, hydroxy-functional materials, polymeric rheology modifiers and mixtures thereof. The rheology modifier imparts shear thinning characteristics to the slurry. Crystalline, hydroxy-functional materials are rheology modifiers which form thread-like structuring systems throughout the matrix of the composition upon in situ crystallization in the matrix. Polymeric rheology modifiers are preferably selected from polyacrylates, polymeric gums, other non-gum polysaccharides, and combinations of these polymeric materials.

The pearlescent agent slurry of the present invention preferably comprise from 40% to 80% by weight of the inorganic pearlescent agent slurry of rheology modifier. Preferably from 40% to 60% by weight, more preferably from 40% to 50% by weight, of the inorganic pearlescent agent slurry herein.

Detersives Surfactants

The slurry may also comprise a surfactant. Said surfactant may be a component of the rheology modifier or not. Surfactant is used in present invention as detersive surfactant for soil suspension purposes.

Detersive surfactants utilized can be of the anionic, nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

The inorganic pearlescent agent slurry of the present invention may comprise from about 6% to 13% by weight of the slurry of a surfactant. Surfactant is a particularly preferred ingredient of the slurry when the rheology modifier is Hydrogenated Castor Oil.

Liquid Treatment Composition

The inorganic pearlescent agent slurry is preferably used as a component of a liquid treatment composition. It is therefore preferable that the slurry meets requirements of the liquid treatment composition and is processable with other components thereof. Suitable components of the liquid treatment composition are listed and discussed in detail below.

The Inorganic Pearlescent Slurry

The slurry is described and discussed in detail above.

Rheology Modifier

The liquid treatment composition preferably comprises rheology modifier, in addition to that used in the pearlescent agent slurry. The function and choice of rheology modifier in the liquid treatment composition is the same as is already described with respect to the slurry.

Detersive Surfactants

The liquid treatment composition preferably comprises detersive surfactant, in addition to that used in the pearlescent agent slurry. The function and choice of detersive surfactant in the liquid treatment composition is the same as is already described with respect to the slurry.

Optional Ingredients of the Liquid Treatment Composition

The liquid treatment composition may comprise other ingredients selected from the list of optional ingredients set out below. Unless specified herein below, an "effective amount" of a particular laundry adjunct is preferably from 0.01%, more preferably from 0.1%, even more preferably from 1% to 20%, more preferably to 15%, even more preferably to 10%, still even more preferably to 7%, most preferably to 5% by weight of the detergent compositions.

Fabric Care Benefit Agents

According to a preferred embodiment of the compositions herein there is comprised a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the treatment composition are suitably at levels of up to about 30% by weight of the composition, more typically from 1% to 20%, preferably from 2% to 10% in certain embodiments.

Builder

The liquid treatment compositions may optionally comprise a builder. Suitable builders are discussed below:

Suitable polycarboxylate builders include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxy-disuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Oxydisuccinates are also especially useful in such compositions and combinations.

Also suitable in the liquid treatment compositions are the 3,3-dicarboxy-4-oxa-1,6-hexanedioates and the related compounds disclosed in U.S. Pat. No. 4,566,984, Bush, issued Jan. 28, 1986. Useful succinic acid builders include the C5-C20 alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP-A-0 200 263, published Nov. 5, 1986.

Specific examples of nitrogen-containing, phosphor-free aminocarboxylates include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA). Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Bleach System

Bleach system suitable for use in liquid treatment compositions contain one or more bleaching agents. Nonlimiting examples of suitable bleaching agents are selected from the group consisting of catalytic metal complexes, activated peroxygen sources, bleach activators, bleach boosters, photobleaches, bleaching enzymes, free radical initiators, and hyohalite bleaches.

Perfume

Perfumes are preferably incorporated into the liquid treatment compositions. The perfume ingredients may be premixed to form a perfume accord prior to adding to the detergent compositions of the present invention. As used herein, the term "perfume" encompasses individual perfume ingredients as well as perfume accords. More preferably the liquid treatment compositions comprise perfume microcapsules. Perfume microcapsules comprise perfume raw materials encapsulated within a capsule made of materials selected from the group consisting of urea and formaldehyde, melamine and formaldehyde, phenol and formaldehyde, gelatine, polyurethane, polyamides, cellulose ethers, cellulose esters, polymethacrylate and mixtures thereof, most preferably the perfume is encapsulated with a shell of melamine and formaldehyde. Encapsulation techniques can be found in "Microencapsulation": methods and industrial applications edited by Benita and Simon (marcel Dekker Inc 1996).

Exemplary perfume ingredients and perfume accords are disclosed in U.S. Pat. Nos. 5,445,747; 5,500,138; 5,531,910; 6,491,840; and U.S. Pat. No. 6,903,061.

Solvent System of Liquid Treatment Composition

The solvent system in the liquid treatment compositions, by contrast with that of the slurry, can be a solvent system containing water alone or mixtures of organic solvents with water. Preferred organic solvents include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the invention, but more typically are present at levels in the range of from 0.1% to 98%, preferably at least 10% to 95%, more usually from 25% to 75%.

Fabric Substantive and Hueing Dye

Dyes are conventionally defined as being acid, basic, reactive, disperse, direct, vat, sulphur or solvent dyes, etc. For the liquid treatment compositions direct dyes, acid dyes and reactive dyes are preferred, direct dyes are most preferred. Direct dyes are a group of water-soluble dye taken up directly by fibers from an aqueous solution containing an electrolyte, presumably due to selective adsorption. In the Color Index system, directive dye refers to various planar, highly conjugated molecular structures that contain one or more anionic sulfonate group. Acid dyes are a group of water soluble anionic dyes that is applied from an acidic solution. Reactive dyes are a group of dyes containing reactive groups capable of forming covalent linkages with certain portions of the molecules of natural or synthetic fibers. From the chemical structure point of view, suitable fabric substantive dyes useful herein may be an azo compound, stilbenes, oxazines and phthalocyanines.

Suitable fabric substantive dyes for use herein include those listed in the Color Index as Direct Violet dyes, Direct Blue dyes, Acid Violet dyes and Acid Blue dyes. The hueing dye is included in the laundry detergent composition in an amount sufficient to provide a tinting effect to fabric washed in a solution containing the detergent.

Encapsulated Composition

The treatment composition, and thus the slurry, of the present invention, may be encapsulated within a water-soluble film. The water-soluble film may be made from polyvinyl alcohol or other suitable variations, including carboxy methyl cellulose, cellulose derivatives, starch, modified starch, sugars, PEG, waxes, or combinations thereof.

In another embodiment the water-soluble film may include other adjuncts such as co-polymer of vinyl alcohol and a carboxylic acid. U.S. Pat. No. 7,022,656 B2 (Monosol) describes such film compositions and their advantages.

The water-soluble film may further comprise additional co-monomers. Suitable additional co-monomers include sulphonates and ethoxylates. An example of preferred sulphonic acid is 2-acrylamido-2-methyl-1-propane sulphonic acid (AMPS). A suitable water-soluble film for use in the context of the present invention is commercially available under tradename M8630™ from Mono-Sol of Indiana, US. The water-soluble film herein may also comprise ingredients other than the polymer or polymer material. For example, it may be beneficial to add plasticisers, for example glycerol, ethylene glycol, diethyleneglycol, propane diol, 2-methyl-1, 3-propane diol, sorbitol and mixtures thereof, additional water, disintegrating aids, fillers, anti-foaming agents, emulsifying/dispersing agents, and/or antiblocking agents. It may be useful that the pouch or water-soluble film itself comprises a detergent additive to be delivered to the wash water, for example organic polymeric soil release agents, dispersants, dye transfer inhibitors. Optionally the surface of the film of the pouch may be dusted with fine powder to reduce the coefficient of friction. Sodium aluminosilicate, silica, talc and amylose are examples of suitable fine powders. The encapsulated pouches can be made using any convention known techniques. More preferably the pouches are made using horizontal form filling thermoforming techniques.

Other Adjuncts

Examples of other suitable cleaning adjunct materials include, but are not limited to, alkoxylated benzoic acids or salts thereof such as trimethoxy benzoic acid or a salt thereof (TMBA); enzyme stabilizing systems; chelants including aminocarboxylates, aminophosphonates, nitrogen-free phosphonates, and phosphorous- and carboxylate-free chelants; inorganic builders including inorganic builders such as zeolites and water-soluble organic builders such as polyacrylates, acrylate/maleate copolymers and the likescavenging agents including fixing agents for anionic dyes, complexing agents for anionic surfactants, and mixtures thereof; effervescent systems comprising hydrogen peroxide and catalase; optical brighteners or fluorescers; soil release polymers; dispersants; suds suppressors; dyes; colorants; filler salts such as sodium sulfate; hydrotropes such as toluenesulfonates, cumenesulfonates and naphthalenesulfonates; photoactivators; hydrolysable surfactants; preservatives; anti-oxidants; anti-shrinkage agents; anti-wrinkle agents; germicides; fungicides; color speckles; colored beads, spheres or extrudates; sunscreens; fluorinated compounds; clays; luminescent agents or chemiluminescent agents; anti-corrosion and/or appliance protectant agents; alkalinity sources or other pH adjusting agents; solubilizing agents; processing aids; pigments; free radical scavengers, and mixtures thereof. Suitable materials include those described in U.S. Pat. Nos. 5,705,464, 5,710,115, 5,698,504, 5,695,679, 5,686,014 and 5,646,101.

Mixtures of adjuncts—Mixtures of the above components can be made in any proportion.

Slurry Preparation

The slurry of the present invention is prepared by mixing the ingredients together. However the order and quantity of addition of inorganic pearlescent agent is important and the inorganic pearlescent agent should be added in two parts. Said process comprises the steps of a) combining organic solvent, selected from the group consisting of glycerol, sorbitol and mixtures thereof and from 10% to 66% by weight of the 100% active inorganic pearlescent agent
b) adding rheology modifier and mixing; and
c) adding remaining inorganic pearlescent agent.

The inorganic pearlescent agents are insoluble and without adequate solution, behave like wet sand, causing problems in processing of the slurry. The wet sand behavior makes the slurry difficult to mix and requires considerable effort from the equipment used in the mixing process. By adding the inorganic pearlescent agent in two parts will produce processable and homogenous slurry. In first inorganic pearlescent agent addition from 10% to 66% by weight of the inorganic pearlescent agent is added in steps and mixed.

Hydrogenated castor oil is a preferred rheology modifier. When hydrogenated castor oil is used as the rheology modifier, it is preferred that a premix of the hydrogenated castor oil and surfactant are prepared in a batch process. The water is heated from 80° C. to 98° C. The surfactant is then added into the solution and pH is adjusted to 7-8 by using a suitable pH adjusting agent e.g. NaOH and buffer. The hydrogenated castor oil rheology modifier is dispersed in solution, at the temperature above the melting point of rheology modifier and the mixture is emulsified. The premix is then crystallized by cooling the emulsion down by 1° C./min±0.2° C./min to an end point of 25° C.

The remaining inorganic pearlescent agent is added in steps and mixed.

The mixing speed of the pearlescent agent slurry depends on the composition of the slurry; higher percentage proportion of pearlescent agent requires faster mixing speed compared to lower percentage of pearlescent agent. Adequate and constant mixing speed is required to ensure blending and incorporation of pearlescent agent. However the shear stress on the process should be kept to a minimum to avoid destroying the network created by the rheology modifier.

EXAMPLES

The following nonlimiting examples are illustrative of the present invention. Percentages are by weight unless otherwise specified.

Viscosity according to the present invention is measured using an AR 550 rheometer from TA instruments using a plate steel spindle at 40 mm diameter and a gap size of 500 μm. The high shear viscosity (HSV) at 20 $s^{-1}$ and low shear viscosity (LSV) at $0.5^{-1}$ can be obtained from a logarithmic shear rate sweep from $0.1^{-1}$ to $25^{-1}$ in 3 minutes time at 21° C.

Example 1

In an example 1, examples A-D are examples of the slurry of the present invention.

| | A | B | C | D |
|---|---|---|---|---|
| Mica | 10.00 | 10.00 | 25.00 | 30.00 |
| Water | 30.40 | 48.64 | 30.40 | 30.40 |

-continued

| | A | B | C | D |
|---|---|---|---|---|
| Glycerol | 50.00 | 26.00 | 35.00 | 30.00 |
| Rheology modifier | 1.60 | 2.56 | 1.60 | 1.60 |
| Surfactant | 6.40 | 10.24 | 6.40 | 6.40 |
| NaOH (50%) | 1.60 | 2.56 | 1.60 | 1.60 |
| Total | 100.00 | 100.00 | 100.00 | 100.00 |
| LSV, cPs | 21013 | 29934 | 32681 | 31386 |
| HSV, cPs | 1101 | 1297 | 1756 | 1821 |

Slurry A

Detailed example of the process of making the slurry A is described in the table below. The table set outs the process through time. Addition of inorganic pearlescent agent in two main steps is indicated in the table as follows: $1^{st}$ mica addition (10%-66% of the weight of the inorganic pearlescent agent) in steps and $2^{nd}$ mica addition (remaining weight of the inorganic pearlescent agent) also in steps.

A batch size is 1100 g and beaker diameter is 140 mm. Impeller type is pitched blade turbine and impeller diameter is 100 mm. The clearance C (mm) is the distance from the bottom of the beaker to the impeller and it can be measured with any measuring device i.e. meter or ruler.

| Step | time (min) | Mixing speed (rpm) | Clearance C (mm) | Amount compound added (g) | Addition rate (kg/min/m^2) |
|---|---|---|---|---|---|
| glycerol addition | 0 | | | | |
| $1^{st}$ mica addition | 1 | 200 | 10 | 6 | 0.39 |
| increase rpm | 1.5 | 400 | 10 | | |
| $1^{st}$ mica addition | 2 | 400 | 10 | 12.24 | 0.80 |
| $1^{st}$ mica addition | 3 | 400 | 10 | 12.56 | 0.82 |
| $1^{st}$ mica addition | 3.5 | 400 | 10 | 6.04 | 0.78 |
| blending | 3.5 | 400 | 10 | | |
| blending | 4 | 100 | 10 | | |
| Rheology modifier addition | 5.5 | 200 | 10 | | |
| increase rpm | 6.5 | 250 | 10 | | |
| Rheology modifier addition | 7.5 | 250 | 10 | | |
| blending | 8 | 200 | 10 | | |
| blending | 9 | 250 | 10 | | |
| $2^{nd}$ mica addition | 10 | 250 | 10 | 13.6 | 0.88 |
| $2^{nd}$ mica addition | 11 | 300 | 10 | 16.4 | 1.07 |
| $2^{nd}$ mica addition | 12 | 300 | 10 | 15.5 | 1.01 |
| $2^{nd}$ mica addition | 12.5 | 300 | 10 | 15 | 1.95 |
| $2^{nd}$ mica addition | 13.5 | 300 | 10 | 13.25 | 0.86 |
| blending | 14 | 250 | 10 | | |
| blending | 17 | 250 | 10 | | |

Slurry B

Detailed example of the process of making the slurry B is described in the table below. The table set outs the process through time. Addition of inorganic pearlescent agent in two main steps is indicated in the table as follows: $1^{st}$ mica addition (10%-66% of the weight of the inorganic pearlescent agent) in steps and $2^{nd}$ mica addition (remaining weight of the inorganic pearlescent agent) also in steps.

A batch size is 1100 g and beaker diameter is 140 mm. Impeller type is pitched blade turbine and impeller diameter is 100 mm. The clearance C (mm) is the distance from the bottom of the beaker to the impeller and it can be measured with any measuring device i.e. meter or ruler.

| Step | time (min) | Mixing speed (rpm) | Clearance C (mm) | Amount compound added (g) | Addition rate (kg/min/m^2) |
|---|---|---|---|---|---|
| glycerol addition | | | | | |
| 1st mica addition | 1 | 200 | 10 | 13.1 | 0.85 |
| 1st mica addition | 2 | 300 | 10 | 15.3 | 0.99 |
| 1st mica addition | 2.5 | 300 | 10 | 8.3 | 1.08 |
| Rheology modifier addition | 3.5 | 300 | 10 | | |
| Rheology modifier addition | 5.5 | 300 | 10 | | |
| blending | 6 | 200 | 10 | | |
| blending | 7 | 200 | 10 | | |
| increase rpm | 7.5 | 350 | | | |
| 2nd mica addition | 8 | 300 | 10 | 14.7 | 0.95 |
| 2nd mica addition | 9 | 400 | 10 | 14.3 | 0.93 |
| 2nd mica addition | 10 | 400 | 10 | 17.4 | 1.13 |
| 2nd mica addition | 11 | 400 | 10 | 13.4 | 0.87 |
| 2nd mica addition | 12 | 400 | 10 | 13.9 | 0.90 |
| blending | 13 | 300 | 10 | | |
| blending | 15 | 300 | 10 | | |

Slurry C

Detailed example of the process of making the slurry C is described in the table below. The table set outs the process through time. Addition of inorganic pearlescent agent in two main steps is indicated in the table as follows: 1st mica addition (10%-66% of the weight of the inorganic pearlescent agent) in steps and 2nd mica addition (remaining weight of the inorganic pearlescent agent) also in steps.

A batch size is 1100 g and beaker diameter is 140 mm. Impeller type is pitched blade turbine and impeller diameter is 100 mm.

| Step | time (min) | Mixing speed (rpm) | Clearance C (mm) | Amount compound added (g) | Addition rate (kg/min/m^2) |
|---|---|---|---|---|---|
| glycerol addition | 0 | | | | |
| 1st mica addition | 1 | 250 | 10 | 16.6 | 1.08 |
| 1st mica addition | 2 | 250 | 10 | 14.7 | 0.95 |
| 1st mica addition | 3 | 250 | 10 | 14.0 | 0.91 |
| 1st mica addition | 4 | 250 | 10 | 16.3 | 1.06 |
| 1st mica addition | 5 | 250 | 10 | 11.4 | 0.74 |
| 1st mica addition | 6 | 250 | 10 | 20.6 | 1.34 |
| blending | 6 | 300 | 10 | | |
| blending | 6.5 | 250 | 10 | | |
| Rheology modifier addition | 7.5 | 300 | 10 | | |
| Rheology modifier addition | 8.5 | 300 | 10 | | |
| blending | 9 | 300 | 10 | | |
| blending | 9.5 | 200 | 10 | | |
| blending | 10 | 200 | 10 | | |
| 2nd mica addition | 11 | 250 | 10 | 16.8 | 1.09 |
| 2nd mica addition | 12 | 250 | 10 | 17.5 | 1.14 |
| 2nd mica addition | 13 | 300 | 10 | 11.8 | 0.77 |
| 2nd mica addition | 14 | 300 | 10 | 13.8 | 0.90 |
| 2nd mica addition | 15 | 300 | 10 | 13.6 | 0.88 |
| 2nd mica addition | 16 | 300 | 10 | 15.3 | 0.99 |
| 2nd mica addition | 17 | 300 | 10 | 16.6 | 1.08 |
| 2nd mica addition | 18 | 350 | 10 | 14.3 | 0.93 |
| 2nd mica addition | 19 | 350 | 10 | 13.6 | 0.88 |
| 2nd mica addition | 20 | 350 | 10 | 16.4 | 1.07 |
| 2nd mica addition | 21 | 350 | 10 | 10.8 | 0.70 |
| 2nd mica addition | 22 | 350 | 10 | 22.4 | 1.45 |
| blending | 22.5 | 400 | 10 | | |
| blending | 23.5 | 300 | 10 | | |
| blending | 25 | 200 | 10 | | |
| blending | 26 | 200 | 10 | | |

Slurry D

Detailed example of the process of making the slurry D is described in the table below. Addition of inorganic pearlescent agent in two main steps is indicated in the table as follows: 1st mica addition (10%-66% of the weight of the inorganic pearlescent agent) in steps and 2nd mica addition (remaining weight of the inorganic pearlescent agent) also in steps.

A batch size is 30 kg and tank diameter is 390 mm. Impeller type is pitched blade turbine and impeller diameter is 250 mm. The clearance C (mm) is the distance from the bottom of the tank to the impeller and it can be measured with any measuring device i.e. meter or ruler.

| Step | Mixing speed (rpm) | Clearance C (mm) | Amount compound added (g) | Addition rate (kg/min/m^2) |
|---|---|---|---|---|
| glycerol addition | 100 | 60 | | |
| 1st mica addition | 100 | 60 | 2980 | 0.80 |
| blending | 100 | 60 | | |
| Rheology modifier addition | 100 | 60 | | |
| blending | 150 | 100 | | |
| 2nd mica addition | 190 | 150 | 5600 | 1.20 |
| blending | 190 | 150 | | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An inorganic pearlescent agent slurry suitable for use in a liquid treatment composition, the slurry consisting of:

a) inorganic pearlescent agent;

b) organic solvent, selected from the group consisting of glycerol, sorbitol and mixtures thereof;

c) rheology modifier; and d) surfactant.

2. A slurry according to the claim 1 wherein the inorganic pearlescent agent is selected from the group consisting of mica, bismuth oxychloride, and mixtures thereof.

3. A slurry according to the claim 1, wherein the inorganic pearlescent agent is metal oxide coated mica.

4. A slurry according to claim 1, wherein the inorganic pearlescent agent is $TiO_2$ coated mica.

5. A slurry according to claim 1, wherein the inorganic pearlescent agent is bismuth oxychloride coated mica.

6. A slurry according to claim 1, wherein the inorganic pearlescent agent is silica coated mica.

7. A slurry according to claim 1, wherein the rheology modifier is selected from the group consisting of non-polymeric crystalline, hydroxy-functional material, polyacrylate, polymeric gum, other non-gum polysaccharide rheology modifiers, and mixtures thereof.

8. A slurry according to claim 1, wherein said surfactant is an anionic surfactant.

9. A slurry according to claim 1, wherein said surfactant is a nonionic surfactant.

10. A slurry according to claim 1, wherein the weight of the solvent is present at a level of from about 10% to about 50% of the weight of the inorganic pearlescent agent slurry.

11. A slurry according to claim 1, wherein the weight of the solvent is present at a level of from about 20% to about 40% of the weight of the inorganic pearlescent agent slurry.

12. A slurry according to claim 1 wherein the inorganic pearlescent agent is present at a level of from about 1% to about 35% of the weight of the inorganic pearlescent agent slurry.

13. A slurry according to claim 1, wherein the inorganic pearlescent agent is present at a level of from about 10% to about 30%.

14. A slurry according to claim 1, wherein the inorganic pearlescent agent is present at a level of from about 10% to about 20% of the weight of the inorganic pearlescent agent slurry.

15. A slurry according to claim 1, wherein the rheology modifier is present at a level of from about 40% to about 80% of the weight of the inorganic pearlescent agent slurry.

16. A slurry according to claim 1, wherein the rheology modifier is present at a level of from about 40% to about 60%.

17. A slurry according to claim 1, wherein the rheology modifier is present at a level of from about 40% to about 50% of the weight of the inorganic pearlescent agent slurry.

18. A slurry according to claim 1, wherein the rheology modifier is present as a premix of hydrogenated castor oil and surfactant.

19. A slurry according to claim 1, wherein the rheology modifier is present as a premix of hydrogenated castor oil and surfactant, wherein the surfactant is present at a level of from about 6% to about 13% of the weight of the rheology modifier premix.

20. A process of preparing the slurry of claim 1, said process comprising the steps of:

i) combining organic solvent with from about 10% to about 66%, by weight, of the inorganic pearlescent agent, wherein the pearlescent agent is 100% active;

ii) adding the rheology modifier to the organic solvent and pearlescent agent, with mixing; and then iii) adding the remaining inorganic pearlescent agent with mixing.

* * * * *